US007238264B2

(12) United States Patent
Kulzer

(10) Patent No.: US 7,238,264 B2
(45) Date of Patent: Jul. 3, 2007

(54) GALVANIZING DEVICE

(75) Inventor: Peter Kulzer, Worms (DE)

(73) Assignee: Cooper Standard Automotive, Inc., Novi, MI (US)

( * ) Notice: Subject to any disclaimer, the term of this patent is extended or adjusted under 35 U.S.C. 154(b) by 177 days.

(21) Appl. No.: 10/661,703

(22) Filed: Sep. 12, 2003

(65) Prior Publication Data

US 2004/0159542 A1 Aug. 19, 2004

(30) Foreign Application Priority Data

Sep. 14, 2002 (DE) ..... 102 42 772

(51) Int. Cl.
*C25D 17/00* (2006.01)

(52) U.S. Cl. ..... 204/198; 204/206

(58) Field of Classification Search ..... 205/133, 205/137, 138, 141; 204/198, 206, 224 R, 204/272, 275.1
See application file for complete search history.

(56) References Cited

U.S. PATENT DOCUMENTS

| | | | | |
|---|---|---|---|---|
| 3,852,170 A * | 12/1974 | Angelini | 205/138 |
| 3,894,924 A | 7/1975 | Toledo | 204/206 |
| 4,003,760 A * | 1/1977 | Labenski et al. | 148/265 |
| 4,419,194 A | 12/1983 | Angelini | 204/25 |
| 4,444,636 A * | 4/1984 | Doetzer et al. | 204/206 |
| 4,820,395 A | 4/1989 | Angelini | 204/207 |
| 6,200,452 B1 | 3/2001 | Angelini | 205/151 |

FOREIGN PATENT DOCUMENTS

| | | | |
|---|---|---|---|
| DE | 42 33 245 A1 | 2/1992 | |
| DE | 44 00 811 | 3/1995 | |
| GB | 761440 | 6/1953 | 41/120 |
| GB | 1 329 136 | 9/1973 | |

* cited by examiner

*Primary Examiner*—Nam Nguyen
*Assistant Examiner*—Luan V. Van
(74) *Attorney, Agent, or Firm*—Young Basile Hanlon MacFarlane & Helmholdt PC

(57) ABSTRACT

A galvanizing device has at least one jet cell with a contact zone located after the jet cell in the direction of transportation of a work piece through the jet cell. At least one partition separates the jet cell from the contact zone. A seal surrounds the workpiece and is situated at an outlet of the jet cell. A pre-baffle surrounds the outlet and acts as a mount for the seal.

8 Claims, 3 Drawing Sheets

GALVANIZING DEVICE

BACKGROUND

The invention relates to a galvanizing device having at least one jet cell through which a work piece to be galvanized, for example, a brake line or similar, is conducted, having a contact zone located after the jet cell in the direction of transportation and at least one partition separating the jet cell from the contact zone and a seal surrounding the work piece which is located between the partition and the jet cell.

In the galvanizing process, electrically conductive liquids (electrolytes) are used in which the work pieces are immersed and in which the work pieces are covered with a metal coating. Aqueous, acidic or alkaline solutions are employed as electrolytes. The anodes consist mostly of the metal to be precipitated. A zinc electrolyte is employed in the zinc coating of metal, for example. The work piece is immersed in the electrolyte and attached to the negative pole (cathode) of a direct current supply. A soluble zinc anode (positive pole) is immersed in the bath at the same time. Under the effects of the direct current, the split salt molecules separate, depending on their charge. The positive zinc ions migrate to the negative pole, i.e., the work piece, and are deposited thereon. The coating is created on the work piece through reduction (electron absorption) of the positive zinc ions. At the same time, the anode gives off zinc ions to the solution, whereby the anode slowly dissolves. The negative ions give off their charge at the anode.

Not only metallic (conductive) work pieces can be coated in this way, but also plastics. For this they are chemically metallized, i.e., made conductive. The range of uses is wide: household objects, sanitary articles or motor vehicle components, for example, brake lines, can be coated.

Brake lines, for example, are zinc-coated in a galvanizing device with high-speed zinc deposition. Jet cells, in which the galvanizing process takes place, are now used as the core of the device. The tube to be galvanized is passed through these jet cells. In addition, zinc electrolyte is pumped through these jet cells at high pressure. A contact zone, by means of which electrical contact is made with the tube, is located between each jet cell section, separated by one or two partitions. The contacts are cooled by means of a coolant circuit. This coolant circuit must be kept separate from the zinc electrolyte circuit. The seal for this is provided between the jet cells and the contact zone by means of plastic stripper plates. These plates are placed over the tubes so that the tube passes through the plates, whereby the electrolyte adhering to the outside of the tube is stripped off. It has turned out to be disadvantageous that the stripper plate touches continuously along the surface of the tube, causing wear on the stripper plate and permanently enlarging the opening through which the tube passes, so that the seal can no longer be guaranteed after a short time.

It is therefore the object of the invention to prepare a galvanizing device in which less electrolyte is entrained and in which the service life of the seal is longer.

SUMMARY

This object is achieved in accordance with the present invention with a galvanizing device in which the seal is provided at the outlet of the jet cell.

This has the considerable advantage that the outside of the tube is cleaned of adhering electrolyte directly at the outlet of the jet cell and the tube, cleaned of electrolyte, covers a specific distance until it passes through the partition toward the contact zone. Moreover, any electrolyte still adhering to the outside of the tube can be additionally removed in this way along this path. This would not be possible if the seal is positioned directly at the inlet of the partition, as in the prior art.

In an improved aspect, the outlet of the jet cell is furnished with a pre-baffle surrounding the outlet. This effect of this pre-baffle is to slow down the stream of electrolyte issuing from the jet cell, and a majority of the electrolyte stream adhering to the tube, or outside of the tube, is stripped off.

In an improved aspect, the pre-baffle acts as a mount for a seal. A seal is installed in addition to the pre-baffle, which seal is attached to the pre-baffle, or is retained by the pre-baffle.

Under the invention, back-pressure is created in the pre-baffle which slows down the electrolyte stream leaving the jet cell. This has the advantage that the slowing down process occurs wear-free, thereby increasing the service life of the device.

Additional advantages, features and details of the invention can be derived from the dependent claims and the description to follow, in which a particularly preferred embodiment is described in detail, considered in reference to the drawing.

The seal is advantageously formed by a stripper plate, which, since it is attached at the pre-baffle, is not subject to wear since it does not touch the galvanized tube. The opening in the stripper plate can be selected such that only a small gap to the work piece remains, so that almost all the electrolyte is stripped off. Entraining of electrolyte into the contact zone is thereby reduced to a minimum.

Overall, it can be established that, on the basis of the present invention, electrolyte loss is minimal, wear at contacts, brackets and copper rails is similarly minimal, environmental pollution is minimal because of the low wear and the loss of electrolyte and the consumption of chemicals is low. Further, there is no risk of blockage of the jet cells from worn stripper platelets. This also means that the jet cells enjoy a longer life. The expense of maintenance is similarly reduced, which lowers operating costs, to which the reduced wear on stripper plates contributes.

BRIEF DESCRIPTION OF THE DRAWING

Additional advantages, features and details of the invention can be derived from the dependent claims and the description to follow, in which a particularly preferred embodiment is described in detail, considered in reference to the drawings.

In the drawing.

DETAILED DESCRIPTION

Figure 1:
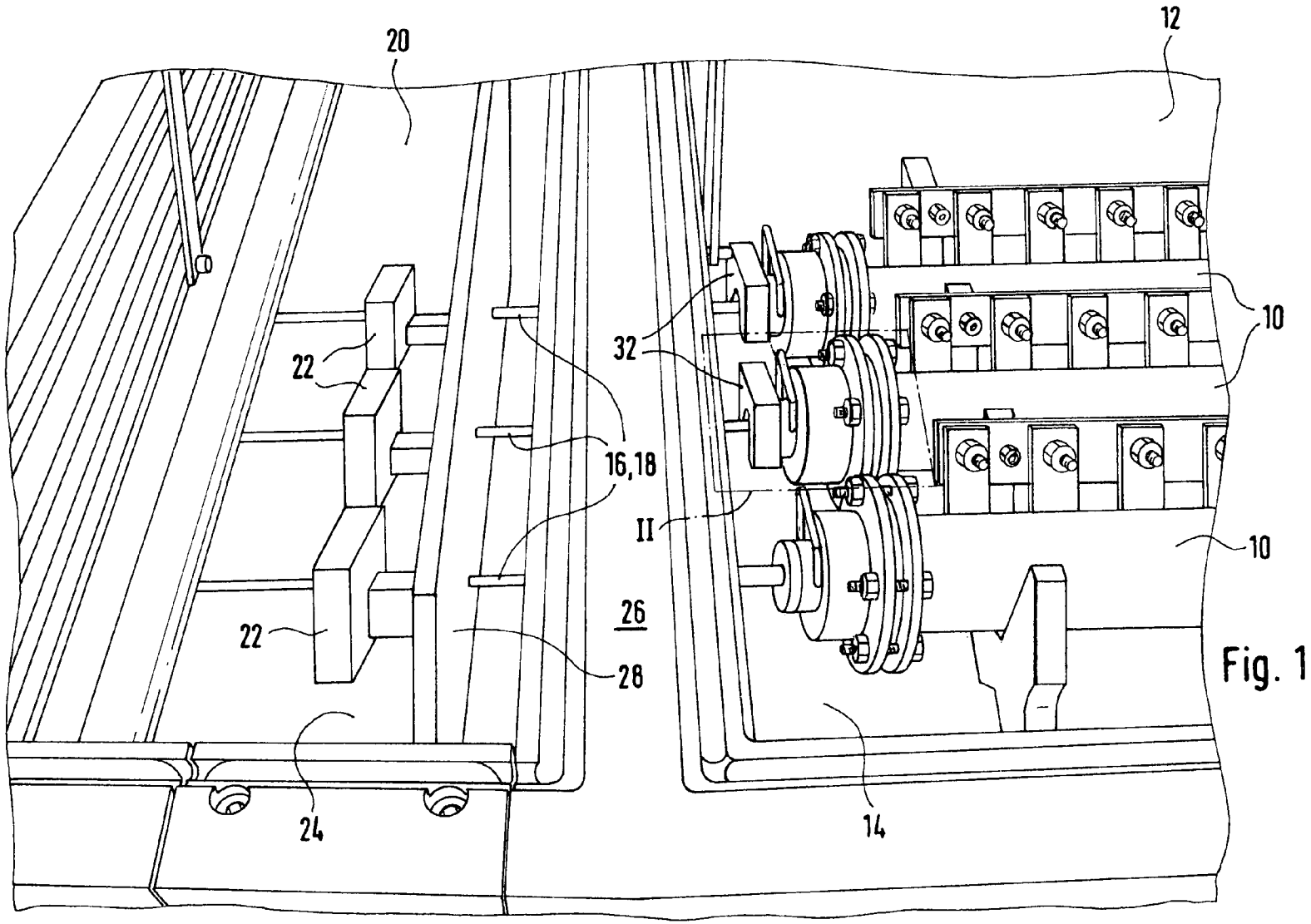
FIG. 1 is a perspective view of the galvanizing device of the invention.

In FIG. 1, a total of three jet cells 10 can be seen which are located in a galvanizing bath 12. A zinc electrolyte flows through the jet cells 10 under high pressure. In addition, a work piece 16, specifically a brake line 18, for example, is passed through each jet cell 10.

The brake line 18 is standing in a contact zone 20, in electrical contact with schematically represented cathodes 22, which are cooled by cooling water 24. A first partition 26 and a second partition 28 can additionally be identified in FIG. 1, which separate the galvanizing bath 12 from the contact zone 20. Entrainment of zinc electrolyte 14 into the contact zone 20 is prevented by the partitions 26, 28.

Figure 2:
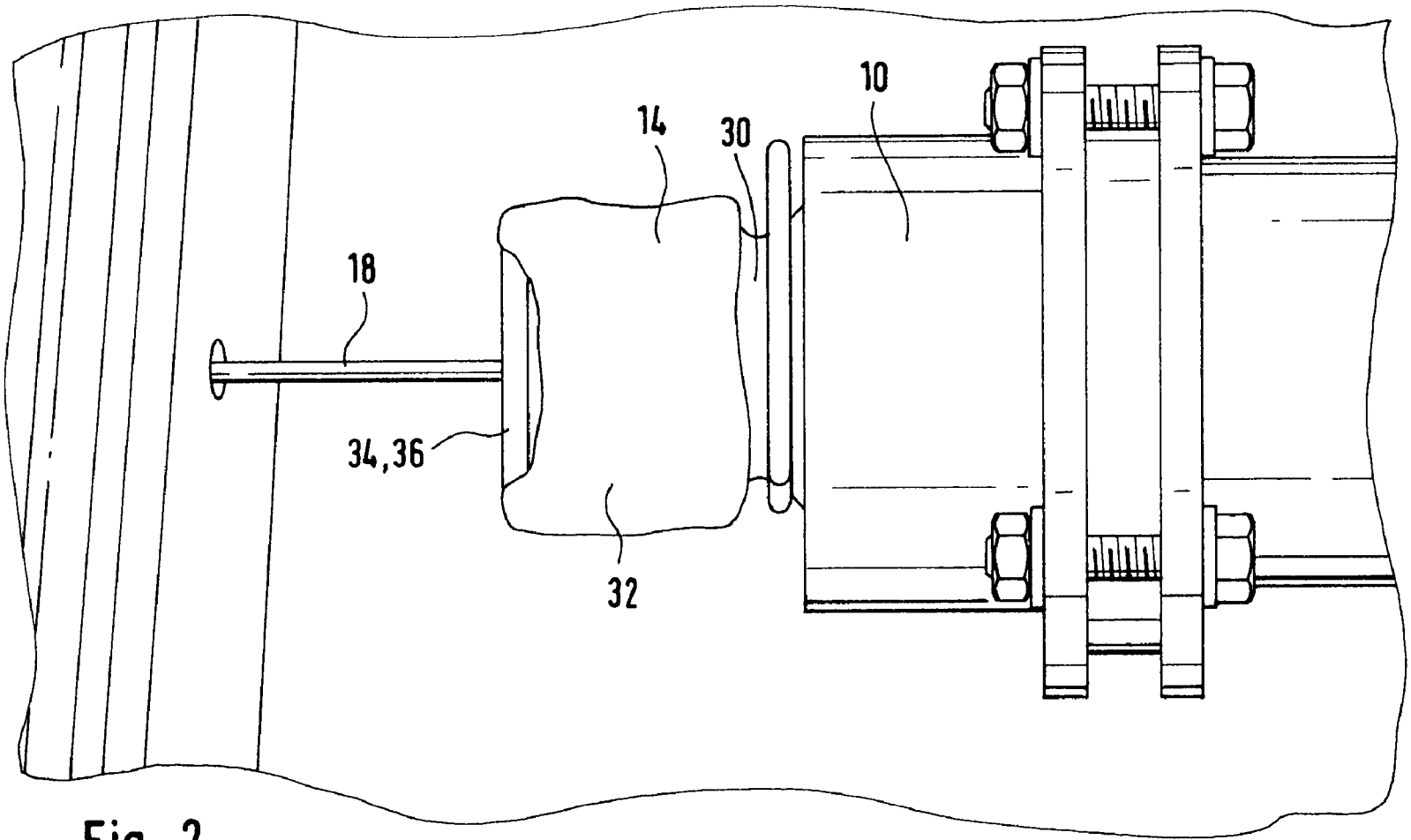
FIG. 2 is a cross-section along plane II in FIG. 1.

In FIG. 2, which shows section II from FIG. 1 in an enlarged rendering, the outlet 30 of the jet cell 10 can be seen, to which a pre-baffle 32 is attached. The pre-baffle 32 generates back-pressure for the zinc electrolyte 14 leaving the outlet 30, which is thereby slowed. The pre-baffle 32 additionally acts as a mount for a seal identified overall with reference numeral 34, which is formed by a stripper plate 36. The stripper plate 36 has an opening which is slightly larger than the outer contour of the brake line 18, so that zinc electrolyte 14 adhering to the outer circumference of the brake line 18 is stripped off without any contact. The brake line 18 is thus free of zinc electrolyte 14. Since the brake line 18 enters the first and the second partition 26 and 28 electrolyte-free, no zinc electrolyte 14 can be entrained into the contact zone 20.

It is also considered to be a further advantage that because the stripper plate 36 is mounted to the pre-baffle 32, the stripper plate 36 is precisely aligned to the brake line 18, so that the plate 36 and the brake line 18 do not touch each other and consequently no wear ensues. The device in accordance with the invention has a long operational life and is environmentally friendly.

Figure 3:
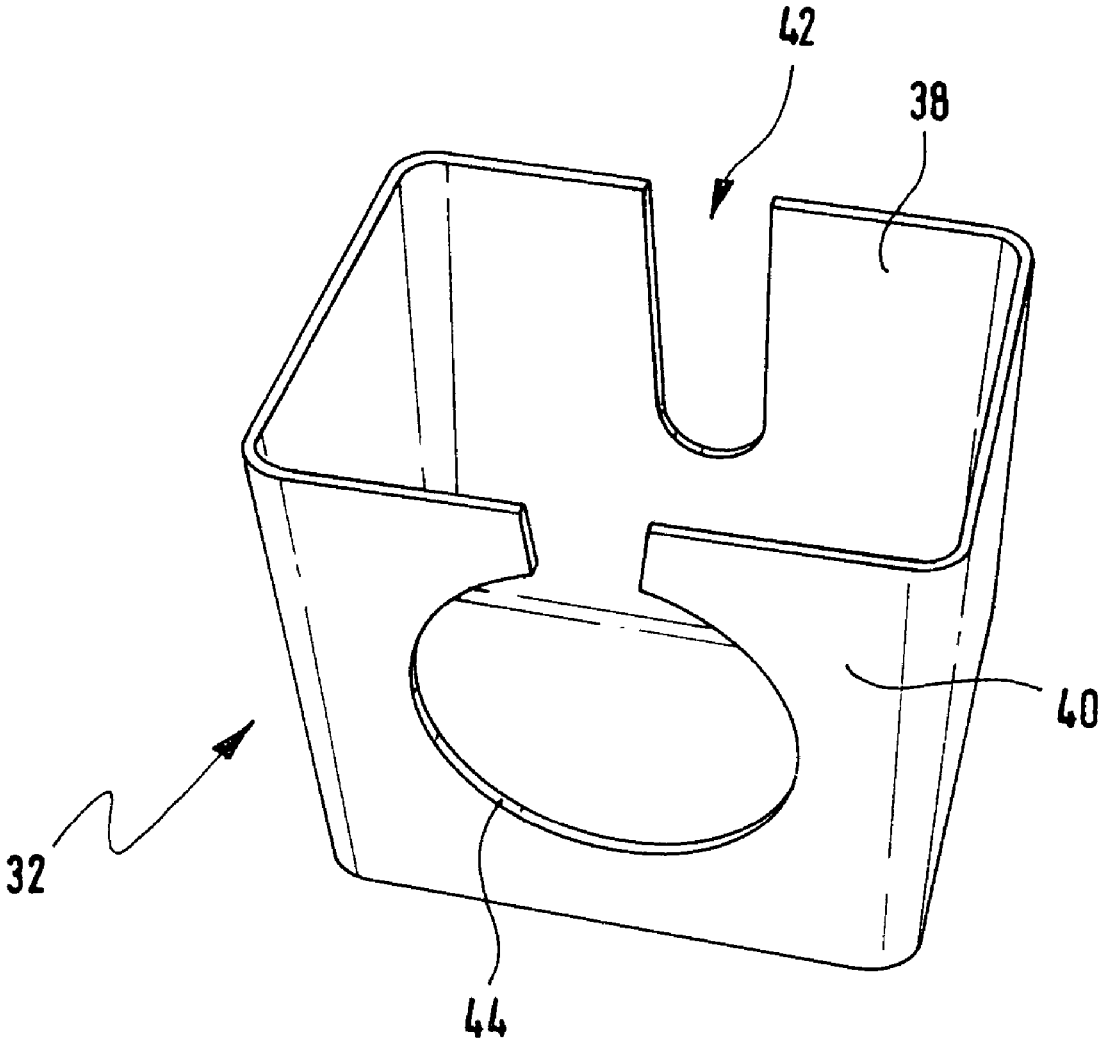
FIG. 3 is a perspective view of the pre-baffle shown in FIG. 1.

How a pre-baffle 32 is used at the outlet 30 of the jet cell 10 is shown in perspective view in FIG. 3. The pre-baffle 32 has essentially a cubic bowl shape, with one side missing. Two side walls 38 and 40 are furnished with openings 42 and 44 which serve firstly to attach the pre-baffle 32 to the outlet 30 of the jet cell 10, and, secondly, to allow the brake line 18 to pass through. The opening 44 is open at its edge so that the pre-baffle 32 can be snapped onto the outlet 30 without difficulty. The opening 42 is essentially slot-shaped so that the pre-baffle 32 can be pushed over the brake line 18: The width of the slot is slightly larger than the outer diameter of the brake line 18, so that entrained electrolyte 14 is for the most part held back. The stripper plate 36, which is held in position by the static pressure of the electrolyte, is placed against the inside of the side wall 38.

The aforementioned features revealed in the drawing, at the description, and in the claims can be essential to the invention, both individually by themselves or in any combination.

The invention claimed is:

1. In a galvanizing device having at least one jet cell with electrolyte pumped through under high pressure, through which a work piece to be galvanized is passed, the galvanizing device having a contact zone located after the jet cell in the direction of transportation and at least one partition separating the jet cell from the contact zone, and a seal surrounding the work piece, the improvement comprising:

a plastic pre-baffle attached to and surrounding the outlet of the jet cell, the pre-baffle having two opposing side walls with two coaxial openings formed in the opposing side walls, the openings slightly larger than an outer dimension of the work piece to slow the high pressure electrolyte stream leaving the jet cell thereby creating back pressure within the jet cell; and the seal situated at the outlet of the jet cell to precisely align with an outer perimeter of the work piece and having a non-contact opening slightly larger than an outer perimeter of the work piece, so that electrolyte adhering to an outer perimeter of the work piece is stripped off without contact.

2. A galvanizing device in accordance with claim 1, wherein the pre-baffle acts as a mount for the seal.

3. A galvanizing device in accordance with claim 1, wherein the pre-baffle is a back-pressure creating pre-baffle, which slows the zinc electrolyte stream leaving the jet cell.

4. A galvanizing device in accordance with claim 2, wherein the seal is formed by a stripper plate held in place by static pressure of the electrolyte.

5. A galvanizing device in accordance with claim 4, wherein the work piece passes through the seal.

6. A galvanizing device in accordance with claim 1, wherein the pre-baffle has an essentially cubic bowl shape.

7. A galvanizing device in accordance with claim 1, wherein the jet cell is configured to galvanize brake lines.

8. In a high speed galvanizing device having at least one jet cell with electrolyte pumped through at high pressure, through which a work piece to be galvanized is passed, the galvanizing device having a contact zone located after the jet cell in the direction of transportation and at least one partition separating the jet cell from the contact zone, and a seal surrounding the work piece, the improvement comprising:

a plastic pre-baffle attached to and surrounding the outlet of the jet cell, the pre-baffle having two opposing side walls with two coaxial openings formed in the opposing side walls, the openings slightly larger than an outer dimension of the work piece to slow the high pressure electrolyte stream leaving the jet cell thereby creating back pressure within the jet cell; and the seal located at the outlet of the jet cell and mounted on the pre-baffle to precisely align with an outer perimeter of the work piece, the seal including a non-contact stripper plate having an opening slightly larger than an outer perimeter of the work piece and held in position against an inside surface of one of the two opposing side walls of the pre-baffle by static pressure of the electrolyte, so that electrolyte adhering to the outer perimeter of the work piece is stripped off without contact thereby entraining less electrolyte into the contact zone and improving service life of the seal.

* * * * *